US006517705B1

(12) United States Patent
Kalnes et al.

(10) Patent No.: US 6,517,705 B1
(45) Date of Patent: Feb. 11, 2003

(54) HYDROCRACKING PROCESS FOR LUBE BASE OIL PRODUCTION

(75) Inventors: Tom N. Kalnes, La Grange, IL (US); Vasant P. Thakkar, Elk Grove Village, IL (US)

(73) Assignee: UOP LLC, Des Plaines, IL (US)

( * ) Notice: Subject to any disclaimer, the term of this patent is extended or adjusted under 35 U.S.C. 154(b) by 85 days.

(21) Appl. No.: 09/813,557

(22) Filed: Mar. 21, 2001

(51) Int. Cl.[7] ..... C10G 47/00

(52) U.S. Cl. ..... 208/102; 208/100; 208/103; 208/104; 208/105; 208/108; 208/111.01; 208/111.3; 208/111.35

(58) Field of Search ..... 208/100, 102, 208/103, 104, 105, 108, 111.01, 111.3, 111.35

(56) References Cited

U.S. PATENT DOCUMENTS 3,159,564 A * 12/1964 Kelley et al. ..... 208/59
4,194,964 A 3/1980 Chen et al. ..... 208/108
5,114,562 A 5/1992 Haun et al. ..... 208/89
5,720,872 A 2/1998 Gupta ..... 208/57
5,980,729 A 11/1999 Kalnes et al. ..... 208/89
6,096,191 A 8/2000 Kalnes et al. ..... 208/105

* cited by examiner

*Primary Examiner*—Walter D. Griffin
(74) *Attorney, Agent, or Firm*—John G. Tolomei; Frank S. Molinaro; John G. Cutts, Jr.

(57) ABSTRACT

A catalytic hydrocracking process for the production of lube base oil wherein a hydrocarbonaceous feedstock is contacted with hydrogen and a metal promoted hydrocracking catalyst in a hydrocracking reaction zone at elevated temperature and pressure to obtain conversion to higher hydrogen-content hydrocarbons including lube base oil. The resulting hot, uncooled effluent from the hydrocracking reaction zone is hydrogen stripped in a hot, high pressure stripping zone maintained at essentially the same pressure as the hydrocracking zone to produce a first gaseous hydrocarbonaceous stream and a first liquid hydrocarbonaceous stream. At least a portion of the first gaseous hydrocarbonaceous stream is condensed to produce a second liquid hydrocarbonaceous stream and a second hydrogen-rich gaseous stream. The first liquid hydrocarbonaceous stream is preferably separated at a pressure greater than atmospheric pressure to provide at least one lube base oil product stream.

20 Claims, 1 Drawing Sheet

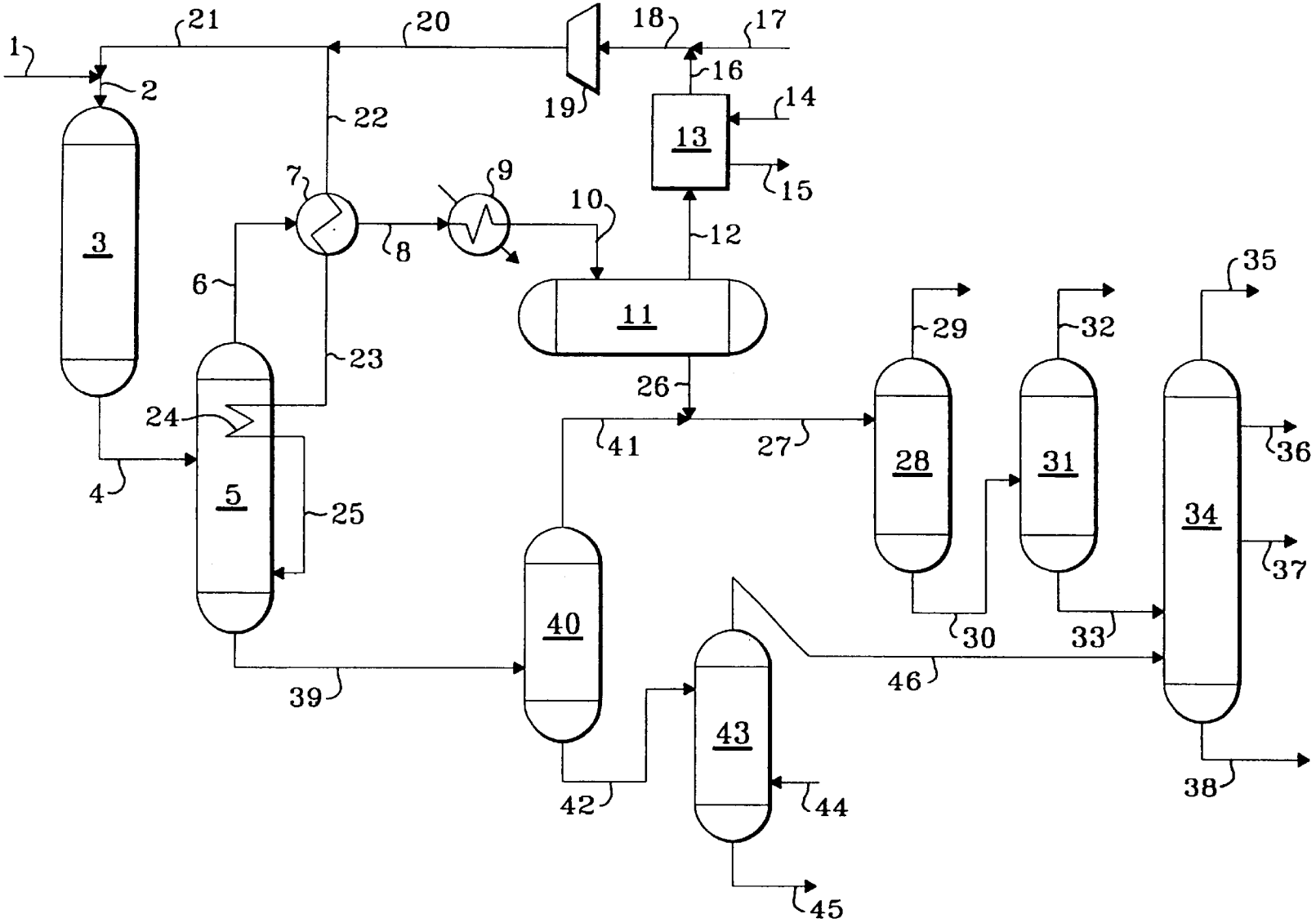
1
2
3
4
5
6
7
8
9
10
11
12
13
14
15
16
17
18
19
20
21
22
23
24
25
26
27
28
29
30
31
32
33
34
35
36
37
38
39
40
41
42
43
44
45
46

HYDROCRACKING PROCESS FOR LUBE BASE OIL PRODUCTION

BACKGROUND OF THE INVENTION

The field of art to which this invention pertains is the hydrocracking of a hydrocarbonaceous feedstock. Petroleum refiners often produce desirable products such as turbine fuel, diesel fuel and lube oil fractions as well as lower boiling hydrocarbonaceous liquids such as naphtha and gasoline by hydrocracking a hydrocarbon feedstock derived from crude oil, for example. Feedstocks most often subjected to hydrocracking are gas oils and heavy gas oils recovered from crude oil by distillation. A typical gas oil comprises a substantial portion of hydrocarbon components boiling above about 700° F., usually at least about 50 percent by weight boiling above 700° F. A typical vacuum gas oil normally has a boiling point range between about 600° and about 1050° F.

Hydrocracking is generally accomplished by contacting in a hydrocracking reaction vessel or zone the gas oil or other feedstock to be treated with a suitable hydrocracking catalyst under conditions of elevated temperature and pressure in the presence of hydrogen so as to yield a product containing a distribution of hydrocarbon products desired by the refiner. The operating conditions and the hydrocracking catalysts within a hydrocracking reactor influence the yield of the hydrocracked products. Although a wide variety of process flow schemes, operating conditions and catalysts have been used in commercial activities, there is always a demand for new hydrocracking methods which provide lower costs and higher liquid product yields. Conventionally, unconverted oil from a hydrocracking plant that was to be used for lube oil production would be fractionated at sub-atmospheric pressure which requires the heating of the hydrocarbon in a fired heater and the subsequent introduction into an expensive vacuum column.

INFORMATION DISCLOSURE

U.S. Pat. No. 5,720,872 (Gupta) discloses a process for hydroprocessing liquid feedstocks in two or more hydroprocessing stages which are in separate reaction vessels and wherein each reaction stage contains a bed of hydroprocessing catalyst. The liquid product from the first reaction stage is sent to a low pressure stripping stage and stripped of hydrogen sulfide, ammonia and other dissolved gases. The stripped product stream is then sent to the next downstream reaction stage, the product from which is also stripped of dissolved gases and sent to the next downstream reaction stage until the last reaction stage, the liquid product of which is stripped of dissolved gases and collected or passed on for further processing. The flow of treat gas is in a direction opposite the direction in which the reaction stages are staged for the flow of liquid. Each stripping stage is a separate stage, but all stages are contained in the same stripper vessel. U.S. Pat. No. 5,114,562 (Haun et al) discloses a process wherein distillable petroleum streams are hydrotreated to produce a low sulfur and low aromatic product utilizing two reaction zones in series. The effluent of the first reaction zone is purged of hydrogen sulfide by hydrogen stripping and then reheated by indirect heat exchange. The second reaction zone employs a sulfur-sensitive noble metal hydrogenation catalyst.

U.S. Pat. No. 5,980,729 (Kalnes et al) discloses a hydrocracking process which utilizes a hot, high-pressure stripper.

U.S. Pat. No. 4,194,964 (Chen et al) discloses a process for the simultaneous distillation and hydrocracking of hydrocarbon feeds in a single vessel.

U.S. Pat. No. 6,096,191 (Kalnes) discloses a catalytic hydrocracking process wherein a hydrocarbonaceous feedstock and a liquid recycle stream having a temperature greater than about 500° F. and saturated with hydrogen is contacted with hydrogen and a metal promoted hydrocracking catalyst in a hydrocracking reaction zone at elevated temperature and pressure to obtain conversion to lower boiling hydrocarbons.

BRIEF SUMMARY OF THE INVENTION

The present invention is a catalytic hydrocracking process which provides lower costs and higher liquid product yields including lube oil. The process of the present invention provides an integrated method for the simultaneous production of various hydrocracked product streams including lube base oil.

In accordance with one embodiment the present invention relates to a process for hydrocracking a hydrocarbonaceous feedstock to produce lower boiling hydrocarbonaceous compounds which process comprises: (a) contacting the hydrocarbonaceous feedstock and hydrogen with a metal promoted hydrocracking catalyst in a hydrocracking zone at elevated temperature and pressure sufficient to obtain a substantial conversion to lower boiling hydrocarbons; (b) stripping the uncooled hydrocarbon effluent from the hydrocracking zone in a hot, high pressure stripping zone maintained at essentially the same pressure as the hydrocracking zone with a first hydrogen-rich gaseous stream to produce a first gaseous hydrocarbonaceous stream and a first liquid hydrocarbonaceous stream; (c) condensing at least a portion of the first gaseous hydrocarbonaceous stream and separating the same into a second liquid hydrocarbonaceous stream and a second hydrogen-rich gaseous stream; (d) recycling at least a portion of the second hydrogen-rich gaseous stream from step (c) to supply at least a portion of the hydrogen in step (a) and at least a portion of the first hydrogen-rich gaseous stream in step (b); and (e) stripping at least a portion of the first liquid hydrocarbonaceous stream to produce a third liquid hydrocarbonaceous stream comprising heavy lube base oil.

In another embodiment the present invention relates to a process for hydrocracking a hydrocarbonaceous feedstock to produce lower boiling hydrocarbonaceous compounds which process comprises: (a) contacting the hydrocarbonaceous feedstock and hydrogen with a metal promoted hydrocracking catalyst in a hydrocracking zone at elevated temperature and pressure sufficient to obtain a substantial conversion to lower boiling hydrocarbons; (b) stripping the uncooled hydrocarbon effluent from the hydrocracking zone in a hot, high pressure stripping zone maintained at essentially the same pressure as the hydrocracking zone with a first hydrogen-rich gaseous stream to produce a first gaseous hydrocarbonaceous stream containing hydrocarbonaceous compounds boiling at a temperature less than about 700° F. and to produce a first liquid hydrocarbonaceous stream containing hydrocarbonaceous compounds boiling at a temperature greater than about 700° F.; (c) condensing at least a portion of the first gaseous hydrocarbonaceous stream and separating the same into a second liquid hydrocarbonaceous stream and a second hydrogen-rich gaseous stream; (d) recycling at least a portion of the second hydrogen-rich gaseous stream from step (c) to supply at least a portion of the hydrogen in step (a) and at least a portion of the first hydrogen-rich gaseous stream in step (b); (e) stripping at least a portion of the first liquid hydrocarbonaceous stream to produce a third liquid hydrocarbonaceous stream comprising heavy lube base oil; and (f) fractionating at least a portion of the second liquid hydrocarbonaceous stream to produce a fourth liquid hydrocarbonaceous stream comprising light lube base oil.

Other embodiments of the present invention encompass further details such as types and descriptions of feedstocks, hydrocracking catalysts and preferred operating conditions including temperatures and pressures, all of which are hereinafter disclosed in the following discussion of each of these facets of the invention.

BRIEF DESCRIPTION OF THE DRAWING

The drawing is a simplified process flow diagram of a preferred embodiment of the present invention. The drawing is intended to be schematically illustrative of the present invention and not be a limitation thereof.

DETAILED DESCRIPTION OF THE INVENTION

The process of the present invention is particularly useful for hydrocracking a hydrocarbon oil containing hydrocarbons and/or other organic materials to produce a product containing hydrocarbons and/or other organic materials of lower average boiling point and lower average molecular weight while simultaneously producing at least one lube oil fraction. The hydrocarbon feedstocks that may be subjected to hydrocracking by the method of the invention include all mineral oils and synthetic oils (e.g., shale oil, tar sand products, etc.) and fractions thereof. Illustrative hydrocarbon feedstocks include those containing components boiling above 550° F., such as atmospheric gas oils, vacuum gas oils, deasphalted, vacuum, and atmospheric residua, hydrotreated residual oils, coker distillates, straight run distillates, pyrolysis-derived oils, high boiling synthetic oils, cycle oils and cat cracker distillates. A preferred hydrocracking feedstock possesses a higher aromatic content or a lower viscosity index than the desired lube oil products. One of the most preferred gas oil feedstocks will contain hydrocarbon components which boil above 550° F. with best results being achieved with feeds containing at least 25 percent by volume of the components boiling between 600° F. and 1000° F.

Also included are petroleum distillates wherein at least 90 percent of the components boil in the range from about 300° F. to about 800° F. The petroleum distillates may be treated to produce both light gasoline fractions (boiling range, for example, from about 50° F. to about 185° F.) and heavy gasoline fractions (boiling range, for example, from about 185° F. to about 400° F.).

The selected feedstock is introduced into a hydrocracking zone. The hydrocracking zone may contain one or more beds of the same or different catalyst. In one embodiment, when the preferred products are middle distillates or high viscosity index lube base stock, the preferred hydrocracking catalysts utilize amorphous bases or low-level zeolite bases combined with one or more Group VII or Group VIB metal hydrogenating components. In another embodiment, when the preferred products are in the gasoline boiling range, the hydrocracking zone contains a catalyst which comprises, in general, any crystalline zeolite cracking base upon which is deposited a minor proportion of a Group VII metal hydrogenating component. Additional hydrogenating components may be selected from Group VIB for incorporation with the zeolite base. The zeolite cracking bases are sometimes referred to in the art as molecular sieves and are usually composed of silica, alumina and one or more exchangeable cations such as sodium, magnesium, calcium, rare earth metals, etc. They are further characterized by crystal pores of relatively uniform diameter between about 4 and 14 Angstroms ($10^{-10}$ meters). It is preferred to employ zeolites having a relatively high silica/alumina mole ratio between about 3 and 12. Suitable zeolites found in nature include, for example, mordenite, stilbite, heulandite, ferrierite, dachiardite, chabazite, erionite and faujasite. Suitable synthetic zeolites include, for example, the B, X, Y and L crystal types, e.g., synthetic faujasite and mordenite. The preferred zeolites are those having crystal pore diameters between about 8–12 Angstroms ($10^{-10}$ meters), wherein the silica/alumina mole ratio is about 4 to 6. A prime example of a zeolite falling in the preferred group is synthetic Y molecular sieve.

The natural occurring zeolites are normally found in a sodium form, an alkaline earth metal form, or mixed forms. The synthetic zeolites are nearly always prepared first in the sodium form. In any case, for use as a cracking base it is preferred that most or all of the original zeolitic monovalent metals be ion-exchanged with a polyvalent metal and/or with an ammonium salt followed by heating to decompose the ammonium ions associated with the zeolite, leaving in their place hydrogen ions and/or exchange sites which have actually been decationized by further removal of water. Hydrogen or "decationized" Y zeolites of this nature are more particularly described in U.S. Pat. No. 3,130,006.

Mixed polyvalent metal-hydrogen zeolites may be prepared by ion-exchanging first with an ammonium salt, then partially back exchanging with a polyvalent metal salt and then calcining. In some cases, as in the case of synthetic mordenite, the hydrogen forms can be prepared by direct acid treatment of the alkali metal zeolites. The preferred cracking bases are those which are at least about 10 percent, and preferably at least 20 percent, metal-cation-deficient, based on the initial ion-exchange capacity. A specifically desirable and stable class of zeolites are those wherein at least about 20 percent of the ion exchange capacity is satisfied by hydrogen ions.

The active metals employed in the preferred hydrocracking catalysts of the present invention as hydrogenation components are those of Group VIII, i.e., iron, cobalt, nickel, ruthenium, rhodium, palladium, osmium, iridium and platinum. In addition to these metals, other promoters may also be employed in conjunction therewith, including the metals of Group VIB, e.g., molybdenum and tungsten. The amount of hydrogenating metal in the catalyst can vary within wide ranges. Broadly speaking, any amount between about 0.05 percent and 30 percent by weight may be used. In the case of the noble metals, it is normally preferred to use about 0.05 to about 2 weight percent. The preferred method for incorporating the hydrogenating metal is to contact the zeolite base material with an aqueous solution of a suitable compound of the desired metal wherein the metal is present in a cationic form. Following addition of the selected hydrogenating metal or metals, the resulting catalyst powder is then filtered, dried, pelleted with added lubricants, binders or the like if desired, and calcined in air at temperatures of, e.g., 700°–1200° F. (371°–648° C.) in order to activate the catalyst and decompose ammonium ions. Alternatively, the zeolite component may first be pelleted, followed by the addition of the hydrogenating component and activation by calcining. The foregoing catalysts may be employed in undiluted form, or the powdered zeolite catalyst may be mixed and copelleted with other relatively less active catalysts, diluents or binders such as alumina, silica gel, silica-alumina cogels, activated clays and the like in proportions ranging between 5 and 90 weight percent. These diluents may be employed as such or they may contain a minor proportion of an added hydrogenating metal such as a Group VIB and/or Group VIII metal.

Additional metal promoted hydrocracking catalysts may also be utilized in the process of the present invention which comprises, for example, aluminophosphate molecular sieves, crystalline chromosilicates and other crystalline silicates. Crystalline chromosilicates are more fully described in U.S. Pat. No. 4,363,718 (Klotz).

The hydrocracking of the hydrocarbonaceous feedstock in contact with a hydrocracking catalyst is conducted in the presence of hydrogen and preferably at hydrocracking conditions which include a temperature from about 450° F. (232° C.) to about 875° F. (468° C.), a pressure from about 500 psig (3448 kPa gauge) to about 3000 psig (20685 kPa gauge), a liquid hourly space velocity (LHSV) from about 0.1 to about 30 $hr^{-1}$, and a hydrogen circulation rate from about 2000 (337 normal $m^3/m^3$) to about 25,000 (4200 normal $m^3/m^3$) standard cubic feet per barrel. In accordance with the present invention, the term "substantial conversion to lower boiling products" is meant to connote the conversion of at least 5 volume percent of the fresh feedstock. It is preferred that this hydrocracking zone also contains hydrotreating catalyst.

In one embodiment, after the hydrocarbonaceous feedstock has been subjected to hydrocracking as hereinabove described, the resulting uncooled effluent from the hydrocracking reaction zone is introduced into a hot, high pressure stripping zone maintained at essentially the same pressure as the hydrocracking zone and contacted with a first hydrogen-rich gaseous stream to produce a first gaseous hydrocarbonaceous stream containing hydrocarbonaceous compounds boiling at a temperature less than about 700° F. and a first liquid hydrocarbonaceous stream containing hydrocarbonaceous compounds boiling at a temperature greater than about 700° F. The hot, high pressure stripping zone is preferably maintained at a temperature in the range from about 450° F. to about 875° F. The effluent from the hydrocracking reaction zone is not substantially cooled and would only be lower in temperature due to unavoidable heat loss during transport from the reaction zone to the hot, high pressure stripping zone. It is preferred that the cooling of the hydrocracking reaction zone effluent is less than about 50° F. By maintaining the pressure of the hot, high pressure stripping zone at essentially the same pressure as the reaction zone is meant that any difference in pressure is due to the pressure drop required to flow the effluent stream from the reaction zone to the hot, high pressure stripping zone. It is preferred that the pressure drop is less than about 50 psig. The hydrogen-rich gaseous stream is preferably supplied in an amount greater than about 2 weight percent of the hydrocarbonaceous feedstock and at least a portion thereof is heat-exchanged with the upwardly flowing gaseous stream in the upper portion of the hot, high pressure stripping zone to partially condense the gaseous stream to produce a liquid reflux for the hot, high pressure stripping zone. At least a portion of the resulting first liquid hydrocarbonaceous stream produced in the hot, high pressure stripping zone is introduced into a hot separator operated at a pressure lower than the hot, high pressure stripping zone to produce a vapor stream and a second liquid stream containing heavy lube base oil. The resulting second liquid stream containing heavy lube base oil is preferably steam stripped at a pressure greater than atmospheric pressure to produce a heavy lube base oil product stream which preferably boils in the range from about 850° F. to about 1050° F. In a preferred embodiment, at least another portion of the first liquid hydrocarbonaceous stream produced in the hot, high pressure stripping zone is recycled to the hydrocracking reaction zone in an amount of about 50% to about 200% of the fresh feedstock. In a preferred embodiment, the per pass conversion in the hydrocracking zone is preferably in the range from 15% to about 45% and more preferably in the range from about 20% to about 40%.

The resulting first gaseous hydrocarbonaceous stream produced in the hot, high pressure stripping zone and containing hydrocarbonaceous compounds characterized by a normal boiling point temperature less than about 850° F. is cooled to a temperature in the range from about 40° F. to about 140° F. to produce a second hydrogen-rich gaseous stream and a third liquid hydrocarbonaceous stream which is flashed, stripped and introduced into a fractionation zone to preferably produce a naphtha product stream, a kerosene product stream, a diesel product stream and a light lube base oil product stream. The fractionation zone preferably operates at a pressure greater than atmospheric pressure. The light lube base oil preferably boils in the range from about 700° F. to about 850° F.

The resulting second hydrogen-rich gaseous stream is bifurcated to provide at least a portion of the added hydrogen introduced into the hydrocracking zone and at least a portion of the first hydrogen-rich gaseous stream introduced into the hot, high pressure stripping zone. At least a portion of the fresh make-up hydrogen is preferably introduced into the hot, high pressure stripping zone. Before the portion of the second hydrogen-rich gaseous stream is introduced into the hydrocracking zone, it is preferred that at least a significant portion, at least about 90 weight percent for example, of the hydrogen sulfide is removed and recovered by means of known, conventional methods.

DETAILED DESCRIPTION OF THE DRAWING

In the drawing, the process of the present invention is illustrated by means of a simplified schematic flow diagram in which such details as pumps, instrumentation, heat-exchange and heat-recovery circuits, compressors and similar hardware have been deleted as being non-essential to an understanding of the techniques involved. The use of such miscellaneous equipment is well within the purview of one skilled in the art.

With reference now to the drawing, a feed stream comprising vacuum gas oil and heavy coker gas oil is introduced into the process via line 1 and admixed with a hydrogen-rich gaseous stream provided via line 21 and the resulting admixture is introduced via line 2 into hydrocracking zone 3. A hydrocracked hydrocarbon stream having components boiling at a temperature less than about 700° F. (371° C.) is recovered from hydrocracking zone 3 via line 4 and is introduced into stripping zone 5. A hydrogen-rich gaseous stream is introduced as a stripping gas via line 25 into stripping zone 5 to produce a gaseous stream effluent containing hydrocarbonaceous compounds boiling at a temperature less than about 850° F. which is removed via line 6 from stripping zone 5 and introduced into heat-exchanger 7. The partially cooled and condensed effluent from heat-exchanger 7 is transported via line 8 and introduced into heat-exchanger 9. The resulting cooled and partially condensed effluent from heat-exchanger 9 is carried via line 10 and introduced into high-pressure separator 11. A hydrogen-rich gaseous stream is removed from high-pressure separator 11 via line 12 and is introduced into acid gas recovery zone 13. A lean solvent is introduced via line 14 into acid gas recovery zone 13 and contacts the hydrogen-rich gaseous stream in order to absorb the acid gas. A rich solvent containing acid gas is removed from acid gas recovery zone 13 via line 15 and recovered. A hydrogen-rich gaseous stream containing a reduced concentration of acid gas is removed from acid gas recovery zone 13 via line 16 and is admixed with a hydrogen makeup stream provided via line 17 and the resulting admixture is introduced via line 18 into compressor 19. A resulting compressed hydrogen-rich gaseous stream is transported via line 20 and at least a portion is recycled via line 21 to hydrocracking zone 3 as described hereinabove. Another portion of the hydrogen-rich gaseous stream is transported via line 22 and introduced into heat-exchanger 7. A resulting heated hydrogen-rich gaseous stream is removed from heat-exchanger 7 via line 23 and is introduced into heat-exchanger 24 and a resulting heated hydrogen-rich gaseous stream is removed from heat-exchanger 24 via line 25 and introduced into stripping zone 5. A liquid hydrocarbonaceous stream containing heavy lube base oil hydrocarbonaceous compounds is removed from stripping zone 5 via line 39 and introduced into flash zone 40 to produce a gaseous stream containing hydrogen and lower boiling hydrocarbonaceous compounds transported via line 41 and a liquid stream containing heavy lube base hydrocarbonaceous compounds transported via line 42 and introduced into stripping zone 43. High pressure steam is introduced via line 44 into stripping zone 43 to produce a gaseous stream containing lower boiling hydrocarbons including a nominal 650–850° F. light lube base stock recovered in line 46 and a liquid stream containing heavy lube base oil hydrocarbonaceous compounds which is removed and recovered by line 45. A liquid stream is removed from high pressure separator 11 via line 26 and is admixed with a previously-described vaporous stream carried via line 41 and the resulting admixture is transported via line 27 and introduced into cold separator 28. A gaseous stream containing hydrogen and normally gaseous hydrocarbons is removed from cold separator 28 via line 29 and recovered. A liquid hydrocarbonaceous stream containing light lube base oil hydrocarbonaceous compounds is removed from cold separator 28 via line 30 and introduced into stripping zone 31. A vapor hydrocarbonaceous stream is removed from stripping zone 31 via line 32 and recovered. A liquid hydrocarbonaceous stream is removed from stripping zone 31 via line 33 and introduced into fractionation zone 34. A naphtha product stream and a kerosene product stream are removed from fractionation zone 34 via lines 35 and 36, respectively, and recovered. A diesel product stream is removed from fractionation zone 34 via line 37 and recovered. A gaseous stream is removed from stripping zone 43 via line 46 and introduced into fractionation zone 34. A liquid hydrocarbonaceous stream containing light lube base oil hydrocarbonaceous compounds is removed from fractionation zone 34 via line 38 and recovered.

The process of the present invention is further demonstrated by the following illustrative embodiment. This illustrative embodiment is, however, not presented to unduly limit the process of this invention, but to further illustrate the advantage of the hereinabove-described embodiment. The following data were not obtained by the actual performance of the present invention but are considered prospective and reasonably illustrative of the expected performance of the invention.

Illustrative Embodiment

A hydrocracker feedstock having the characteristics presented in Table 1 is hydrocracked in a hydrocracking zone containing a hydrocracking catalyst at operating conditions presented in Table 2 to yield the products described in Table 3. The product qualities are presented in Table 4.

TABLE 1

| Hydrocracker Feedstock Analysis | |
|---|---|
| Specific Gravity | 0.922 |
| Density, ° API | 22 |
| Distillation, Volume Percent | |
| IBP, ° C. | 215 |
| 5% | 358 |
| 10% | 386 |
| 30% | 428 |
| 50% | 455 |
| 70% | 484 |
| 90% | 522 |
| 95% | 539 |
| FBP | 569 |
| Sulfur, weight percent | 2.33 |
| Nitrogen, ppm | 890 |
| Viscosity @50° C. (cSt) | 38.7 |

TABLE 2

| Summary of Operating Conditions | |
|---|---|
| Pressure, psig | 1800 |
| Hydrocracker LHSV, $hr^{-1}$ | 2.0 |
| Overall Conversion, weight percent | 90 |

TABLE 3

| Product Yield Summary | | |
|---|---|---|
| | Wt. % | |
| Gas Products | | SCFB |
| $NH_3$ | 0.11 | |
| $H_2S$ | 2.48 | |
| $C_1$ | 0.21 | 15.7 |
| $C_2$ | 0.28 | 11.6 |
| $C_3$ | 1.17 | 32.6 |
| Liquid Products | | Vol. % |
| $C_4$ | 2.75 | 4.4 |
| $C_5$ | 3.46 | 5.1 |
| Light Naphtha | 5.12 | 6.7 |
| Heavy Naphtha | 16.20 | 19.9 |
| Kerosene | 22.02 | 25.3 |
| Diesel | 39.25 | 43.4 |
| Unconverted Oil | 10.0 | 10.7 |
| $C_7$+ | 85.92 | 99.3 |
| $C_5$+ | 95.21 | 111.1 |
| Full Range Diesel | 61.27 | 68.7 |

TABLE 4

| Product Quality | |
|---|---|
| Heavy Naphtha | |
| Density, ° API | 57.3 |
| Sulfur, ppm | <10 |
| Nitrogen, ppm | <0.2 |
| Research Octane No. | 54.5 |
| Kerosene | |
| Density, ° API | 44.7 |
| Sulfur, ppm | <10 |
| Nitrogen, ppm | <0.2 |
| Flash Point, ° F. | 133 |

TABLE 4-continued

| Product Quality | | | |
|---|---|---|---|
| Smoke Point | | 24 | |
| Aromatics, LV % | | 13 | |
| Diesel | | | |
| Density, ° API | | 38 | |
| Sulfur, ppm | | <10 | |
| Nitrogen, ppm | | <0.2 | |
| Cetane No. | | 59 | |
| Waxy Lube Cuts | API | Viscosity @210° F., C st | V.I. |
| Light Lube Cut (80 Neutral) | 33.6 | 3.32 | 100 |
| Heavy Lube Cut (200 Neutral) | 32.1 | 6.65 | 115 |

The foregoing description, drawing and illustrative embodiment clearly illustrate the advantages encompassed by the process of the present invention and the benefits to be afforded with the use thereof.

What is claimed:

1. A process for hydrocracking a hydrocarbonaceous feedstock to produce lower boiling hydrocarbonaceous compounds which process comprises:

(a) contacting the hydrocarbonaceous feedstock and hydrogen with a metal promoted hydrocracking catalyst in a hydrocracking zone at elevated temperature and pressure sufficient to obtain a substantial conversion to lower boiling hydrocarbons;

(b) stripping the uncooled hydrocarbon effluent from the hydrocracking zone in a hot, high pressure stripping zone maintained at essentially the same pressure as the hydrocracking zone with a first hydrogen-rich gaseous stream to produce a first gaseous hydrocarbonaceous stream and a first liquid hydrocarbonaceous stream;

(c) condensing at least a portion of the first gaseous hydrocarbonaceous stream and separating the same into a second liquid hydrocarbonaceous stream and a second hydrogen-rich gaseous stream;

(d) recycling at least a portion of the second hydrogen-rich gaseous stream from step (c) to supply at least a portion of the hydrogen in step (a) and at least a portion of the first hydrogen-rich gaseous stream in step (b); and (e) stripping at least a portion of the first liquid hydrocarbonaceous stream to produce a third liquid hydrocarbonaceous stream comprising heavy lube base oil.

2. The process of claim 1 wherein the hydrocracking zone is maintained at a pressure from about 500 psig (3448 kPa) to about 3000 psig (20685 kPa).

3. The process of claim 1 wherein the hydrocracking zone is maintained at a temperature from about 450° F. (232° C.) to about 875° F. (468° C.).

4. The process of claim 1 wherein the metal promoted hydrocracking catalyst comprises synthetic faujasite.

5. The process of claim 1 wherein the metal promoted hydrocracking catalyst comprises an amorphous base.

6. The process of claim 1 wherein the metal promoted hydrocracking catalyst comprises a metal selected from Group VIII and Group VIB.

7. The process of claim 1 wherein the hydrocarbonaceous feedstock boils at a temperature greater than about 650° F. (343° C.).

8. The process of claim 1 wherein the first hydrogen-rich gaseous stream is introduced into step (b) at a rate of greater than about 2 weight percent of the hydrocarbonaceous feedstock.

9. The process of claim 1 wherein the stripping conducted in step (e) is performed at a pressure greater than atmospheric pressure.

10. A process for hydrocracking a hydrocarbonaceous feedstock to produce lower boiling hydrocarbonaceous compounds which process comprises:

(a) contacting the hydrocarbonaceous feedstock and hydrogen with a metal promoted hydrocracking catalyst in a hydrocracking zone at elevated temperature and pressure sufficient to obtain a substantial conversion to lower boiling hydrocarbons;

(b) stripping the uncooled hydrocarbon effluent from the hydrocracking zone in a hot, high pressure stripping zone maintained at essentially the same pressure as the hydrocracking zone with a first hydrogen-rich gaseous stream to produce a first gaseous hydrocarbonaceous stream containing hydrocarbonaceous compounds boiling at a temperature less than about 700° F. and to produce a first liquid hydrocarbonaceous stream containing hydrocarbonaceous compounds boiling at a temperature greater than about 700° F.;

(c) condensing at least a portion of the first gaseous hydrocarbonaceous stream and separating the same into a second liquid hydrocarbonaceous stream and a second hydrogen-rich gaseous stream;

(d) recycling at least a portion of the second hydrogen-rich gaseous stream from step (c) to supply at least a portion of the hydrogen in step (a) and at least a portion of the first hydrogen-rich gaseous stream in step (b);

(e) stripping at least a portion of the first liquid hydrocarbonaceous stream to produce a third liquid hydrocarbonaceous stream comprising heavy lube base oil; and (f) fractionating at least a portion of the second liquid hydrocarbonaceous stream to produce a fourth liquid hydrocarbonaceous stream comprising light lube base oil.

11. The process of claim 10 wherein the hydrocracking zone is maintained at a pressure from about 500 psig (3448 kPa) to about 3000 psig (20685 kPa).

12. The process of claim 10 wherein the hydrocracking zone is maintained at a temperature from about 450° F. (232° C.) to about 875° F. (468° C.).

13. The process of claim 10 wherein the metal promoted hydrocracking catalyst comprises synthetic faujasite.

14. The process of claim 10 wherein the metal promoted hydrocracking catalyst comprises an amorphous base.

15. The process of claim 10 wherein the metal promoted hydrocracking catalyst comprises a metal selected from Group VII and Group VIB.

16. The process of claim 10 wherein the hydrocarbonaceous feedstock boils at a temperature greater than about 650° F. (343° C.).

17. The process of claim 10 wherein the first hydrogen-rich gaseous stream is introduced into step (b) at a rate of greater than about 2 weight percent of the hydrocarbonaceous feedstock.

18. The process of claim 10 wherein the heavy lube base oil boils in the range from about 850° F. to about 1000° F.

19. The process of claim 10 wherein the light lube base oil boils in the range from about 700° F. to about 850° F.

20. The process of claim 10 wherein steps (e) and (f) are performed at a pressure greater than atmospheric pressure.

* * * * *